US005755631A

United States Patent [19]

Paschka

[11] Patent Number: 5,755,631

[45] Date of Patent: May 26, 1998

[54] VOLLEYBALL PRACTICE DEVICE AND METHOD OF USE THEREOF

[76] Inventor: Gary M. Paschka, 9125 Grenoble Dr., Milan, Mich. 48160

[21] Appl. No.: 542,092

[22] Filed: Oct. 12, 1995

[51] Int. Cl.[6] ..... A63B 69/00

[52] U.S. Cl. ..... 473/459; 473/424

[58] Field of Search ..... 273/411, 412, 273/413; 473/422, 423, 424, 459

[56] References Cited

U.S. PATENT DOCUMENTS

| | | | |
|---|---|---|---|
| 4,561,661 | 12/1985 | Walker | 273/413 |
| 4,881,742 | 11/1989 | Hargreave | 273/411 |
| 4,948,150 | 8/1990 | Daly | 273/411 |
| 5,060,946 | 10/1991 | Taylor | 273/411 |
| 5,238,251 | 8/1993 | Staka | 273/411 |

FOREIGN PATENT DOCUMENTS

| | | | |
|---|---|---|---|
| 2328493 | 1/1975 | Germany | 273/411 |
| 3232323 | 3/1988 | Germany | 273/411 |
| 2004278 | 12/1993 | Russian Federation | 273/411 |
| 636000 | 12/1978 | U.S.S.R. | 273/411 |
| 1377127 | 2/1988 | U.S.S.R. | 273/411 |

*Primary Examiner*—Mark S. Graham
*Attorney, Agent, or Firm*—Donald P. Gillette

[57] ABSTRACT

A device to be used in practicing to play volleyball includes a ball rotatably mounted on the end of a long, somewhat flexible wand. The other end of the wand is held by a coach. The coach positions the wand so that the ball is above a volleyball net in position to be struck by a player in an effort to make the ball follow a trajectory similar to the trajectory a free volleyball would follow if spiked in a game of volleyball, including such rotation as would be imparted to the ball by the manner in which the player struck it.

12 Claims, 2 Drawing Sheets

VOLLEYBALL PRACTICE DEVICE AND METHOD OF USE THEREOF

BACKGROUND OF THE INVENTION

1. Field of the Invention

This invention relates to the game of volleyball. In particular, the invention relates to a device that facilitates practicing certain moves important to successful playing of the game and to the method of practicing those moves.

2. The Prior Art

In the game of volleyball, as played competitively, there are two teams, of five players each, on opposite sides of a rectangular court that has an elevated net strung across its center. A volleyball is hit back and forth across the net by the two teams until one team is unable to return the ball before it hits the ground. The other team is then awarded a point, and the first team to score 21 points wins the game. Except for the serve that starts each point, it is permissible for the players of the team on the side where the ball is in play to hit the ball from teammate to teammate, provided the ball is not allowed to touch the ground and provided there are no more than two such hits. On the third hit, the volleyball must go over the net to the other side.

However, it is not necessary that the ball be hit three times before going back across the net. A player who is close to the net can intercept the ball as it crosses the net and strike it forcefully so directly toward the ground on the side from which it came that no player on that side can intercept it.

Another play, called spiking the ball, is such an important play in the game of volleyball that players need to practice it a great deal. In this play, a first player, usually in the rear part of the court, receives a ball hit by someone on the opposite team and bumps the ball up in the air. As the ball comes down, normally in the central region of the court, a second player on the same team then hits the ball up again, which is called "setting" it, this time trying to cause it to be directed toward a third player near the front of the court, i.e., near the net. The third player is the one who is supposed to spike the ball by jumping to meet it and striking it at a sufficient altitude so that it will not only be projected across the net but will be on a somewhat downward path and at such a high velocity that no player on the opposing team can get under it before its hits the ground. It is the forceful striking of the ball in a forward and downward direction by the third player that is called "spiking the ball."

One of the difficulties of practicing spiking is that the ball must be in a position above the net, yet still within the jumping reach of the practicing player. This can be achieved by having a partner, who may or may not be the team coach, hit the ball into the desired area time after time, but if the ball is free, it will have to be chased down on one side of the net or the other after every spiking attempt, depending on whether the attempt is successful or not. To make such retrieval of the ball unnecessary, several complex devices have been created to hold the volleyball in the desired position to allow the practicing player to try to hit it.

U.S. Pat. No. 4,372,561 obtained by Morgan et al. shows a volleyball practice apparatus in which a volleyball is held between horizontal elastic cords strung between two posts that form part of a frame attached to a volleyball net. The cords must be put in place for each practice session, and the volleyball is always in one position. While the posts can be adjusted to change the height of the volleyball above the net, this cannot easily be done after each spiking attempt.

U.S. Pat. No. 4,523,762 to Garner shows game apparatus for playing something resembling volleyball, but the ball is tied to a long tether and is no more easily positioned for practicing spiking than an entirely free ball would be.

Hargreave discloses a volleyball practice structure in U.S. Pat. No. 4,881,742 in which a ball in a net bag is suspended by a cord from a horizontal arm. The bag with the ball in it can be struck by a practicing player, but the feel will be different from regular play due to the fact that the ball, being suspended from above and constrained within the bag, cannot be rotated on a substantially horizontal axis, which is the way a volleyball responds to a spiking blow in a game.

Greene et al. describe a very complex apparatus in U.S. Pat. No. 4,887,821 in which an untethered volleyball is held in a valley formed between the juxtaposed ends of a pair of aligned, soft cylinders. The ball would have to be replaced in the valley after having been either caught or retrieved each time it was struck.

U.S. Pat. No. 4,948,150 to Daly et al. discloses a ball enclosed within a bag that is suspended from a horizontal backstop disc attached to a rod that is connected an overhead beam. The ball would not rotate when spiked in the way that it would if free to do so.

U.S. Pat. No. 5,060,546 to Taylor discloses a ball that has a ring on one side and is suspended from a beam by a rope connected to the beam and to the ring. As in the Daly et al. device, the ball would not be free to rotate about a generally horizontal axis as it does when spiked in a game of volleyball.

Staka describes a very complex device for practicing hitting a volleyball in U.S. Pat. No. 5,238,251. The ball is attached non-rotationally to one end of an L-shaped rod the other end of which is connected to a cam mounted to rotate on an axis perpendicular to a plate at the upper end of a vertical post and can be set to be horizontal or angularly offset from horizontal. The ball can be supported above a net, and the ball is supposed to be struck in a direction perpendicular to the plate, and when it is properly struck, it causes the cam to rotate. While the ball is said to be mounted in a cup of rubber or the like, there is no indication of how the ball is secured to the cup, which is shown as standing on edge. The fact that the cup is rigidly attached to the end of the rod prevents it, and the ball attached to it, from rotating about an axis common to the cup and the end of the rod to which it is attached. The ball is not free to move or to rotate in the way that it does in a volleyball game.

U.S. Pat. No. 5,094,462 to Boyle et al. describes training apparatus for soccer not volleyball.

OBJECTS AND SUMMARY OF THE INVENTION

It is an object of this invention to provide a hand-held device for use in training volleyball players to spike a ball.

An additional object is to provide a device having a captive ball that closely resembles a regulation volleyball in size in the way it responds to being struck.

A further object is to provide a flexible wand that allows a volleyball, or its equivalent, mounted on the end of the wand to be held in a realistic place to be struck by a practicing player and to be able to rotate about an axis coaxial with the axis of the end on which it is mounted.

Those who are skilled in the technology with which this invention deals will recognize further objects after studying the following description.

In accordance with this invention a ball that has the size and feel of a volleyball, and may, in fact, actually be a volleyball, is firmly attached to one end of a flexible wand by a support that allows the ball to rotate about an axis coincident with the axis of the wand. The support includes one part that is rigidly attached to the end of a wand and a second part rotatable about the axis of the portion of the wand at that end. The other end of the wand is held by a practicing player's partner, who has enough control over the wand to place the ball in position to be spiked and to return the ball to that position quickly after each blow by the practicing player. The wand may be made in two sections, one of which can telescope into the other to minimize the length of the device when it is not in use.

The invention will be described in greater detail in connection with the drawings, in which like serial numbers in different figures indicate the same item.

DETAILED DESCRIPTION OF A PREFERRED EMBODIMENT

Figure 1:
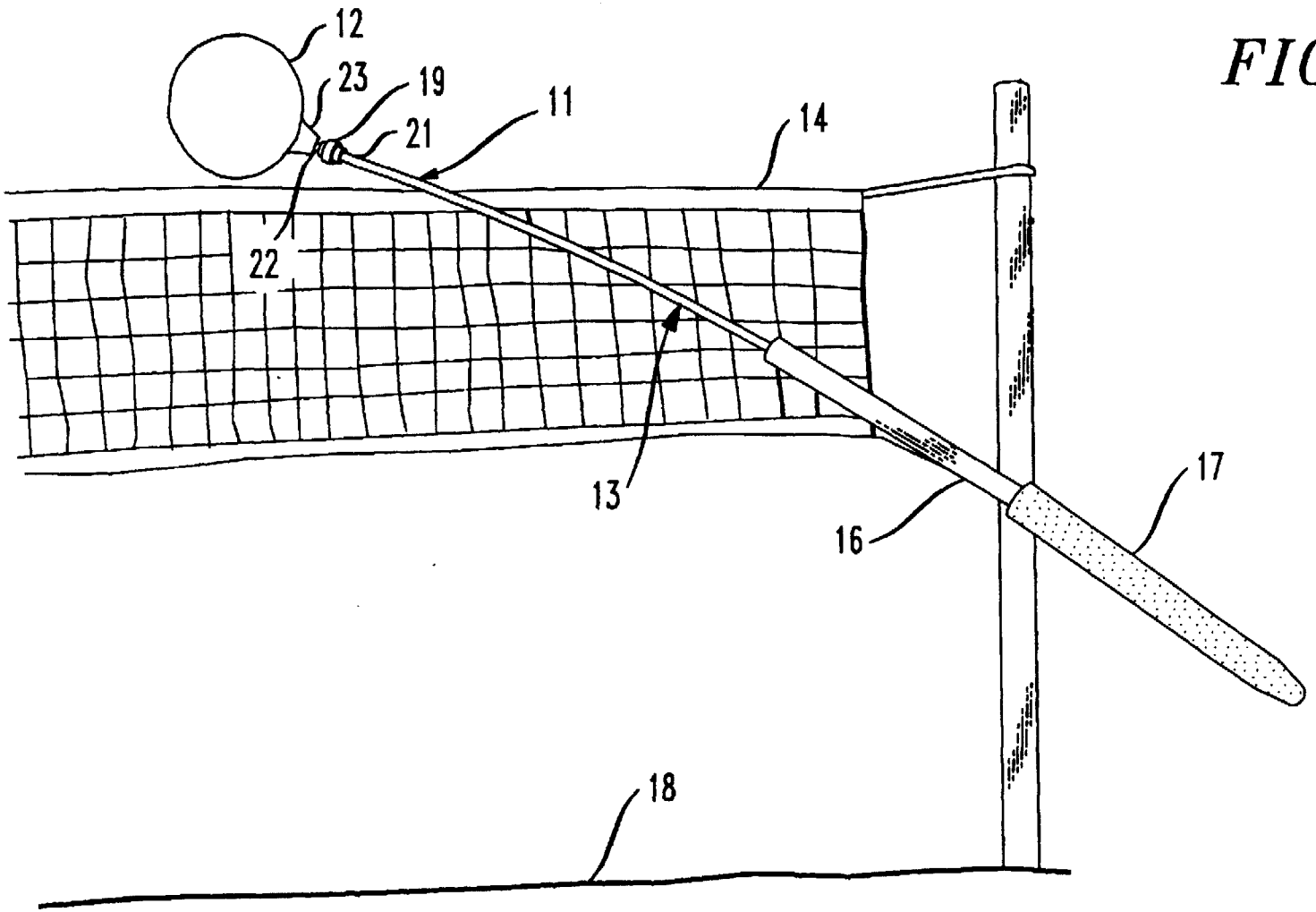
FIG. 1 is a side view of a volleyball practice device in position to be used according to this invention.

FIG. 1 shows a volleyball practice device 11 in accordance with this invention comprising a ball 12 at the end of an elongated wand 13 just over a net 14. While the wand appears to be bent, that is only because of its flexibility, which allows the ball to move relatively freely when it is hit by a player, and especially when it is hit in the correct direction. The wand 13 is not self-supported nor supported by any other inanimate structure. Instead, a handle 16 at the of the wand remote from the ball is to be held by a second person, called a setup person, when a player is practicing hitting the ball. To make the handle more comfortable to hold, it is provided with a sponge rubber grip 17.

The setup person, who is likely to be a coach, but who may be anyone willing to perform the task of holding and guiding the ball 12, is required to bring the ball back into a suitable position to be hit again each time the player hits it. Such a position is not always precisely the same as that of the previous hit, which is one of the reasons why the volleyball practice device 11 is to be preferred over purely mechanical devices to hold the ball 12.

Another advantage of having the volleyball practice device controlled by a human being is that the blows struck by the player will not be identical with one another and will not cause the ball to move in the same direction or with the same momentum each time. It is desirable that the ball 12 be hit in a direction generally toward the floor 18 and with sufficient force to cause it actually to strike the floor 18 within a range determined primarily, but not exclusively, by the length of the wand 13. The setup person may have to let the entire wand and handle swing in response to the blow in order to allow the ball to reach the floor, as desired. Whether or not the setup person allows the wand 13 to swing that far is, to some degree, a matter of judgment; if the blow is deemed too soft, the wand should not be allowed to swing far enough for the ball to reach the floor. Having some degree of control over the response of the ball 12 and the wand also affords the setup person a way of determining whether the player is hitting the ball in the proper direction. Furthermore, the ball 12 may not always be returned to precisely the same position when it is to be hit. In order to provide realistic practice for a game, the ball may be placed at different heights above the net and at different positions along the net.

I have found that a wand approximately 4' long is a good length, but it may be from about 3.5' to 6', or even more. Since the top of the net is about 7' from the floor, a 4' wand would not be long enough to allow the ball, when hit, to strike the floor if the handle 16 were held in a fixed position.

In order to be light enough to be held and moved easily and with precision by the second person, the wand should be slender, typically on the order of about 0.18" to about 0.44" diameter at the end where the ball 12 is located, but the precise diameter depends on the type of material of which the wand 13 is made. Furthermore, the wand may be made of tapered stock ranging from a thickness of about 0.44" to about 0.6" at the larger end to a thickness of about 0.18" to about 0.44" at the smaller end where the ball is attached. However, tapering is not mandatory; I have found that a tempered steel rod having a uniform diameter of ¼" provides excellent resilience for rapid movement of the ball when it is hit, yet still allows the setup person to control the ball well.

Typically, when the ball 12 is properly spiked, frictional engagement of the player's hands on its surface imparts rotation as well as forward motion to the ball. It is important to connect the ball 12 to the wand 13 in such a way as to allow the ball to rotate as it would if it were entirely free. Since the ball cannot be allowed to move from side to side relative to the wand 13, a coupling 19 is attached to the end 21 of the wand and to a short shaft 22 gripped by a projection 23 firmly bonded to the ball 12. The coupling allows the shaft 22 and the ball to rotate about an axis common to the axis of the end of the wand 13. The rotation normally imparted to a free ball would be about an axis more or less parallel to the floor 18, and in order to allow the ball 12 to rotate about such an axis, it is necessary that the setup person hold the wand 13 so that its end 21 will be close to parallel with the floor or will at least be at an angle not substantially greater than 30° to the floor.

Figure 2:
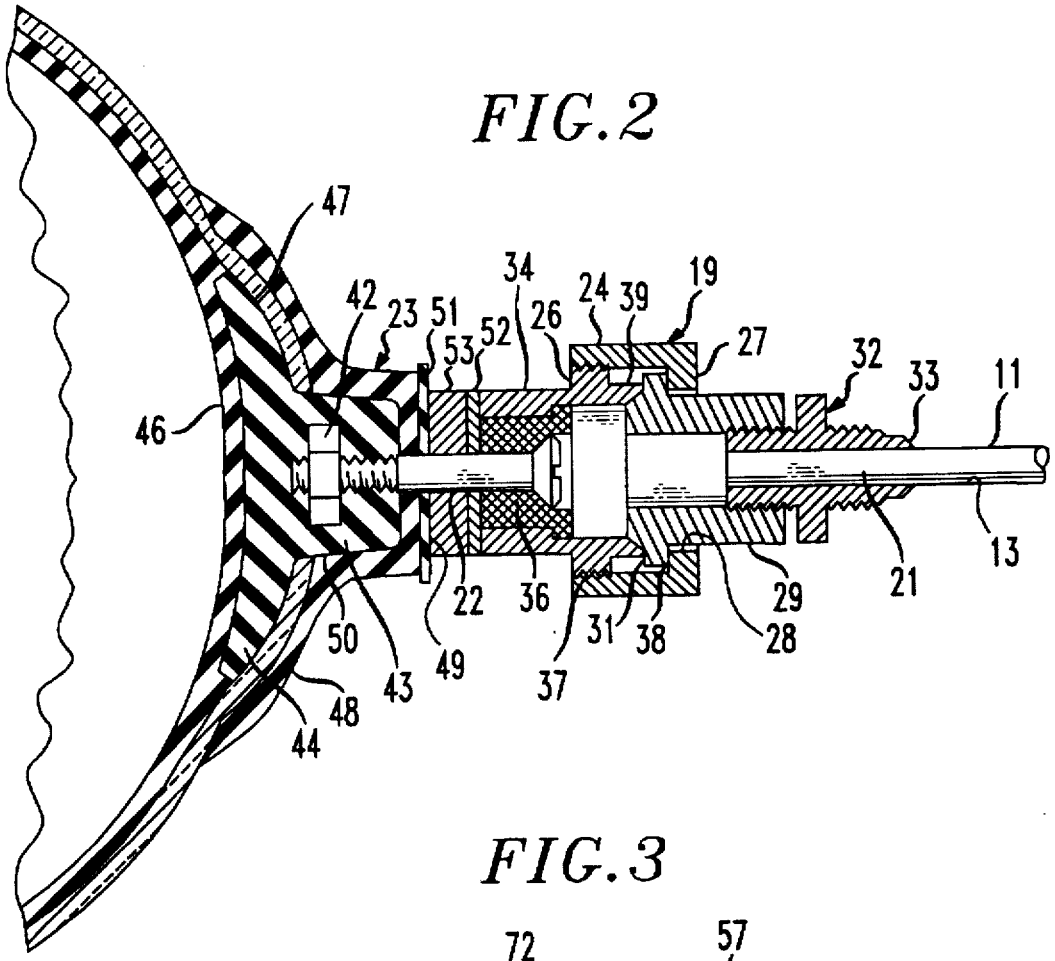
FIG. 2 is a cross-sectional view of coupling means suitable for use in the volleyball practice device in FIG. 1.

FIG. 2 is a cross-sectional view of one embodiment of a coupling 19 that I have successfully used. This coupling is similar to a pipe union having a central member 24 having an internal thread 26 at one axial end and an inwardly directed flange 27 at the opposite end. The flange has a central hole 28 through which extends a tubular member 29 that has, at one end, an outwardly extending flange 31 of larger diameter than the hole 28. One end of the tubular member is internally threaded to receive one externally threaded end of a solid coupling member 32, or flare adapter, tightly screwed into it. The coupling member has a central channel of the proper size to fit tightly on the end 21 of the wand 13, which must be firmly held in place. This can be done by soldering or brazing these components together, as indicated at reference numeral 33.

The coupling 19 comprises another generally tubular member 34, which concentrically surrounds a porous, bronze bushing 36 and the short, inner shaft 22 for which the bushing 36 forms a low-friction bearing. The tubular member 34 has an external thread 37 to screw into the thread 26 to force a central conical cavity 38 tightly against a central conical projection 39 on the juxtaposed end of the tubular member 29 to hold both of these tubular members rigidly together and in axial alignment with each other and with the wand 13, the central member 24, and the shaft 22. While the external, longitudinal surfaces of the central member 24 and the two tubular members 29 and 34, which correspond, respectively, to components of a standard pipe union, are formed with facets defining hexagons, the external surfaces of the members 24, 29 and 34 in the embodiment in FIG. 2 are round so as to reduce the possibility of injury to a player attempting to strike the ball 12. The tight, threaded engagement required to hold these members rigidly together can still be obtained by well-known frictional wrenches.

The inner shaft 22 is essentially a bolt with a conical head 41 that is threaded into a nut 42 embedded in a short stem 43 of a suction cup 44. The suction cup is firmly in engagement with the bladder 46 of the ball 12. The bladder is reached via a cut in the outer leather layer 47. In order to hold the suction cup against the bladder, even when the ball is struck hard, the stem has an outer layer 48 formed on it and comprising multiple layers of liquid rubber painted on the external surface of the adjacent part of the stem 43. In this embodiment, the layer 48 is further strengthened by nylon thread 50 wound around the stem 43 as the layer 48 is being formed. The stem has a flat end surface 49, and the outer layer 48 has a similar flat part 51 formed over the surface 49. Both the stem 43 and the flat part 51 have aligned central holes to receive the inner shaft 22 and to allow its threaded end to be screwed into the embedded nut 42.

While the inner shaft must be screwed tightly into the nut, it must not be so tight as to prevent easy rotation of the ball 12 relative to the wand 13. A flat metal washer 52 is located at the end of the bushing 36 and the tubular member 34, and a fiber washer 53 is placed between the washer 52 and the flat part 51 to reduce friction and thus make it easier to obtain the desired rotation of the ball 12 relative to the wand 13.

Figure 3:
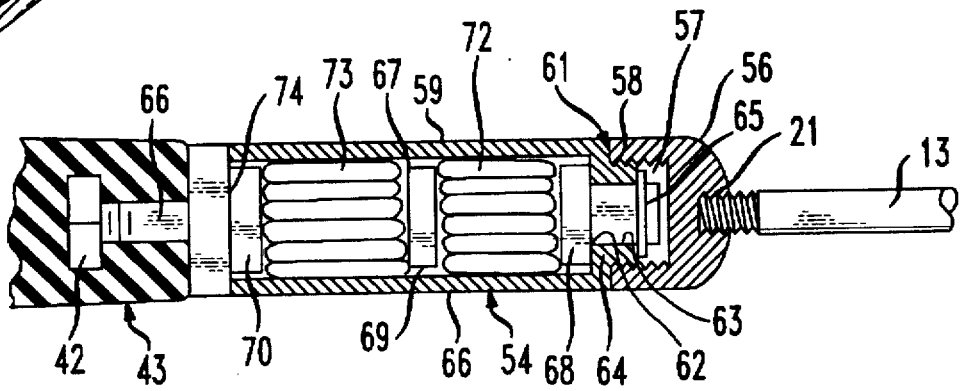
FIG. 3 is a cross-sectional view of another embodiment of coupling means suitable for use in the volleyball practicing device in FIG. 1.

While the embodiment of the coupling 19 in FIG. 2 allows the ball 12 to rotate relatively freely, it is desirable to improve the freedom of rotation still more. FIG. 3 shows a coupling 54 for doing so. In this figure, the threaded end 21 of the wand 13 is screwed into a rounded end of a fitting 56 at one end of the coupling. The other axial end of the fitting has an internally threaded recess 57 screwed tightly onto a threaded end 58 of a hollow, cylindrical shell 59.

One end of an axle 61 in the shell has an axial projection 62 that extends through, and is freely rotatable in, a central hole 63 in a transverse plug 64 in the shell. The axle is held in place by a spring clip 65 that prevents any axial movement that would separate the axle from the wand 13. The other end of the axle comprises a threaded shaft 66 screwed into the nut 42. As in the embodiment in FIG. 2, this threaded shaft and the nut on it are embedded in the stem 43 of the suction cup 44 that is a principal holding member for attaching the wand 13 to the ball 12.

The axle 61 has two bearing races 67 and 68 defined between flanges 69–71 and containing two sets of needle, or roller, bearings 72 and 73, respectively. These two sets of bearings are axially spaced along the coupling as in this embodiment to withstand better the force of blows applied to the ball 12 (FIG. 2) when the volleyball practice device 11 is in use. Between the flange 71 and the stem 43 is a washer 74 that can be pressed firmly against the flat end of the stem when the coupling 54 is assembled, as shown. This flange is slightly spaced from the proximal end of the shell 59 to allow the axle 61 and the stem 43 to turn freely with respect to the shell and the fitting 56 and the wand 13 whenever the ball 12 is properly struck in a way that would cause it to be spiked if it were a free ball in a game.

Figure 4:
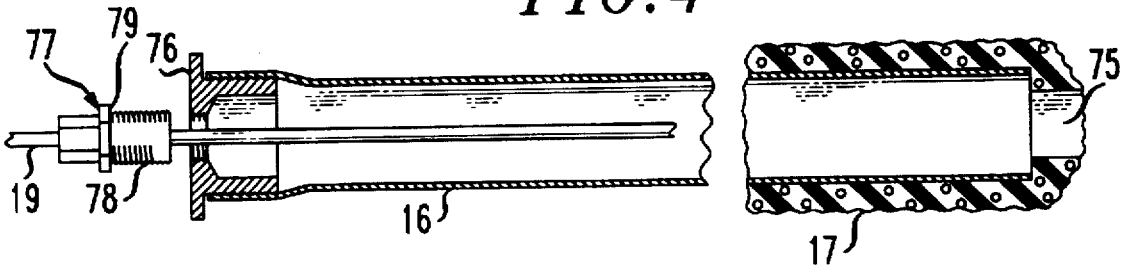
FIG. 4 is a cross-sectional view of a telescopic handle as used in the practice device of FIG. 1.

FIG. 4 shows an embodiment of the device 11 in which provision is made for allowing it to be shortened to make it easier to carry around when it is not in use in training volleyball players. In this embodiment, the handle 16 is hollow and is separate from the wand 13 to allow the wand to be telescoped into the handle. As shown in this cross-sectional view, at the end of the handle 16 is the relatively soft grip 17, which has a central opening 75, and at the other end is an internally threaded plug 76, which is forcibly inserted into the tubular handle to be held rigidly in place in spite of any forces applied to the volleyball practice device in use. The plug 76 serves as a first attachment means for securing the wand 13 to the handle 16. In this embodiment, the length of the plug is not substantially greater than its diameter. A bushing 77 having an external thread 78 is rigidly attached to the wand 13 at a distance of several inches from the end opposite the end 21 shown in FIG. 2. Preferably, this distance is between about 1/10 and 1/6 of the length of the handle 16. The bushing serves as a second attachment means for securing the wand 13 to the handle and has flat surfaces 79 to facilitate screwing it tightly into the plug 76 to hold the wand 13 in the extended position shown in FIG. 1 to allow the device 11 to be used as a training device, as described.

When the device 11 is not in use, the bushing 77 is unscrewed from the plug 76, and that end is then inserted through the hole 75 into the hollow handle 16. By making the handle 16 about four feet long and just a little longer than the wand, the device 11 may be about eight feet long when in use and only about half that long when it is to be carried away from the practice area. By making the hole 75 have an unstressed, or natural, diameter somewhat less than the external diameter of the tubular member 29, the resilient material 17 grips the member 29 firmly enough to keep the wand from separating from the handle too easily while the device is being transported. When the handle shown in FIG. 4 is used with the embodiment of the coupling in FIG. 3, the natural diameter of the hole 75 should be a little smaller than the external diameter of the shell 59 to prevent the wand from separating too easily from the handle while being transported.

This invention has been described in specific terms, but it will be understood that the invention is not limited to the embodiment shown.

What is claimed is:

1. A volleyball practice device comprising:

(a) a ball;

(b) a substantially straight, flexible, elongated wand having first and second end portions;

(c) rotatable securing means for mounting the ball on the first end portion of the wand to secure the ball against being dislodged from the wand while simultaneously allowing the ball to rotate about an axis coincident with the wand when the ball is struck; and (d) a handle secured to the second end portion of the wand and in alignment therewith, the handle being relatively rigid in comparison with the wand to facilitate control and placement of the ball.

2. The volleyball practice device of claim 1 in which the ball has an airtight, internal bladder and an outer cover, and the rotatable securing means comprises a projection extending through the outer cover and having a flange extending outwardly from one end of the projection between the bladder and the outer cover.

3. The volleyball practice device of claim 2 in which the projection comprises a housing for securing means, the securing means comprising a first bearing member secured within the housing and a second bearing member freely rotatable with the first bearing member and secured to the first end portion of the wand.

4. The volleyball practice device of claim 2 in which the securing means comprises thrust bearing means to withstand pressure on the ball in the direction of the axis and rotary bearing means to allow rotation of the ball about the axis in response to being struck, the thrust bearing means being secured within the projection.

5. The volleyball practice device of claim 2 in which the projection comprises:

(a) a main stem of elastomeric material, the flange being formed integrally therewith and extending from one end thereof;

(b) a threaded shaft coaxial with the main stem and extending from the other end of the main stem and comprising a head extending laterally out from the shaft;

(c) an extension member coaxial with the main stem and having, at one end, an axial recess with an inwardly directed flange surrounding the head of the threaded shaft and rotationally joined thereto, the other end of the extension member being securely attached to the first end portion of the wand.

6. The volleyball practice device of claim 5 in which the first end portion of the wand comprises an externally threaded section, and the other end of the extension member is internally threaded and is screwed onto the externally threaded section.

7. A volleyball practice device comprising:

(a) a ball;

(b) a flexible, elongated wand having first and second end portions; and (c) rotatable securing means mounting the ball on the first end portion of the wand to secure the ball against being dislodged from the wand while simultaneously allowing the ball to rotate about an axis coincident with the first end portion when the ball is struck;

(d) a hollow handle at least substantially as long as the wand and inflexible in comparison with the wand, the handle having first and second ends and first attachment means near its second end; and (e) second attachment means on the wand near the second end portion thereof to interlock with the first attachment means to hold the wand either in a first position in which all but a short part of the wand adjacent the second end portion thereof extends from the handle or in a second position in which only the short part of the wand extends from the handle.

8. The volleyball practice device of claim 7 in which the first attachment means is an internally threaded member in the region of the first end of the handle, and the second attachment means may be an externally threaded member coaxial with the wand and securely attached thereto to be securely threaded into the internally threaded member.

9. The volleyball practice device of claim 8 in which the first attachment means is a short plug having one end portion force-fit into said one end of the handle and having a length not substantially greater than its diameter.

10. The volleyball practice device of claim 8 in which the second attachment means is a threaded bushing rigidly attached to the wand and spaced from the second end thereof by a distance between about 1/10 and 1/6 of the length of the handle.

11. The volleyball practice device of claim 8 in which the handle is about 4 ft. long.

12. The method of having a player practice spiking a volleyball over a net having a top at a certain level above a court using a volleyball practice device comprising a ball; a flexible, elongated wand having first and second end portions; and rotatable securing means mounting the ball on the first end portion of the wand to secure the ball against being dislodged from the wand while simultaneously allowing the ball to rotate about an axis coincident with the first end portion when the ball is struck, said method comprising:

(a) having a first person hold the wand in a spiking position to place the ball at a level approximately equal to the level of the top of the net with the first end portion at an acute angle to the court;

(b) having the player strike the ball in a direction at an angle of at least 45 to the first end portion of the wand; and (c) having the first person return the wand to the spiking position.

* * * * *